United States Patent [19]

Downing

[11] 4,120,603

[45] Oct. 17, 1978

[54] JET FLAP CONTROLLED FUEL PUMP

[75] Inventor: Noel L. Downing, Indianapolis, Ind.

[73] Assignee: General Motors Corporation, Detroit, Mich.

[21] Appl. No.: 781,701

[22] Filed: Mar. 28, 1977

[51] Int. Cl.[2] ..... F04D 17/00

[52] U.S. Cl. ..... 415/11; 415/28; 415/52; 415/143; 415/148; 415/157

[58] Field of Search ..... 415/11, 26, 27, 28, 415/52–59, 143–148, 157

[56] References Cited

U.S. PATENT DOCUMENTS

| | | | |
|---|---|---|---|
| Re. 28,946 | 8/1976 | Martz et al. | 415/17 |
| 2,865,297 | 12/1958 | Cliborn et al. | 415/53 |
| 3,070,025 | 12/1962 | Cliborn | 415/11 |
| 3,504,986 | 4/1970 | Jackson | 415/11 |
| 3,588,266 | 6/1971 | Scott et al. | 415/11 |

*Primary Examiner*—C. J. Husar
*Attorney, Agent, or Firm*—J. C. Evans

[57] ABSTRACT

An inducer for a high speed centrifugal pump includes a shaft located upstream of the inlet eye of the centrifugal pump concentrically within an inlet bore; and further includes a plurality of axial blades on an inducer shaft for producing a boost pressure to the inlet of the centrifugal pump and wherein means are included to direct a spray of fuel in a direction radially of the longitudinal axis of the shaft immediately upstream of the blades to reduce the amount of fuel flow across the inducer with a resultant lowered pressure rise than would otherwise occur.

3 Claims, 4 Drawing Figures

JET FLAP CONTROLLED FUEL PUMP

This invention relates to fuel pumps and more particularly to high speed centrifugal pumps having upstream inducers for controlling fuel flow to the inlet eye of the centrifugal pump.

High speed centrifugal pumps used in fuel systems for a gas turbine engine may have a cylindrical core of vapor upstream thereof.

In order to overcome such vapor core action in high speed centrifugal pump operation it is desirable to provide an upstream flow inducer to direct liquid fuel to the inlet eye of the centrifugal pump adding sufficient inlet pressure to overcome vapor pressure of the fluid being pumped by the fuel supply system.

While such systems are suitable for their intended purpose they are characterized by certain flow in stabilities produced during minimum fuel flow conditions in the supply system to the pump where the centrifugal pump itself is operated at high speeds on the order of 25,000 to 30,000 rpm. One approach to stabilization of flow is set forth in U.S. Pat. No. 3,504,986, issued Apr. 7, 1970, to Jackson for Wide Range Inducer. In this arrangement, flow is bypassed around an inducer when downstream pressure increases. However, the bypassed fluid is returned to the main flow well upstream of the impeller without affecting main flow rate across the inducer impeller.

Accordingly, an object of the present invention is to improve an inducer upstream of a constant high speed centrifugal type fuel pump for an aircraft gas turbine engine having an afterburner mode of operation, by the provision of an upstream inducer shaft including a plurality of axial flow blades for pressurizing fuel flow into the centrifugal impeller eye to maintain the pressure therein above the vapor pressure of the fuel being pumped and to further include means for sensing elevated pressure differentials across the inducer axial flow blades under minimum fuel flow conditions and means responsive to such elevated pressure differential to produce a radial spray of fuel immediately upstream of the inlet edge of the inducer blades with the jet spray acting to reduce the inlet velocity flow of fuel into the inducer to produce less fuel flow and a reduced pressure across the inducer than would otherwise occur thereby to stabilize fuel flow conditions from the inducer and to the centrifugal impeller during low fuel modes of operation.

Yet another object of the present invention is to provide a system as set forth in the preceding object wherein the inducer includes a shaft extension connected to the centrifugal impeller and having a bypass passage therein from the low pressure inlet edge of the inducer blades to the high pressure outlet edge thereof and a valve means to control flow from the passage in a direction radially outwardly of the rotating shaft at a point immediately upstream of the inlet edge of the blade to define a jet spray curtain for producing a resultant reduction in the axial flow component of inlet fuel to the inducer blade to thereby cause a reduction in fuel pumped by the inducer and a lower pressure rise thereacross than would otherwise occur.

Further objects and advantages of the present invention will be apparent from the following description, reference being had to the accompanying drawings wherein a preferred embodiment of the present invention is clearly shown.

Figure 1:
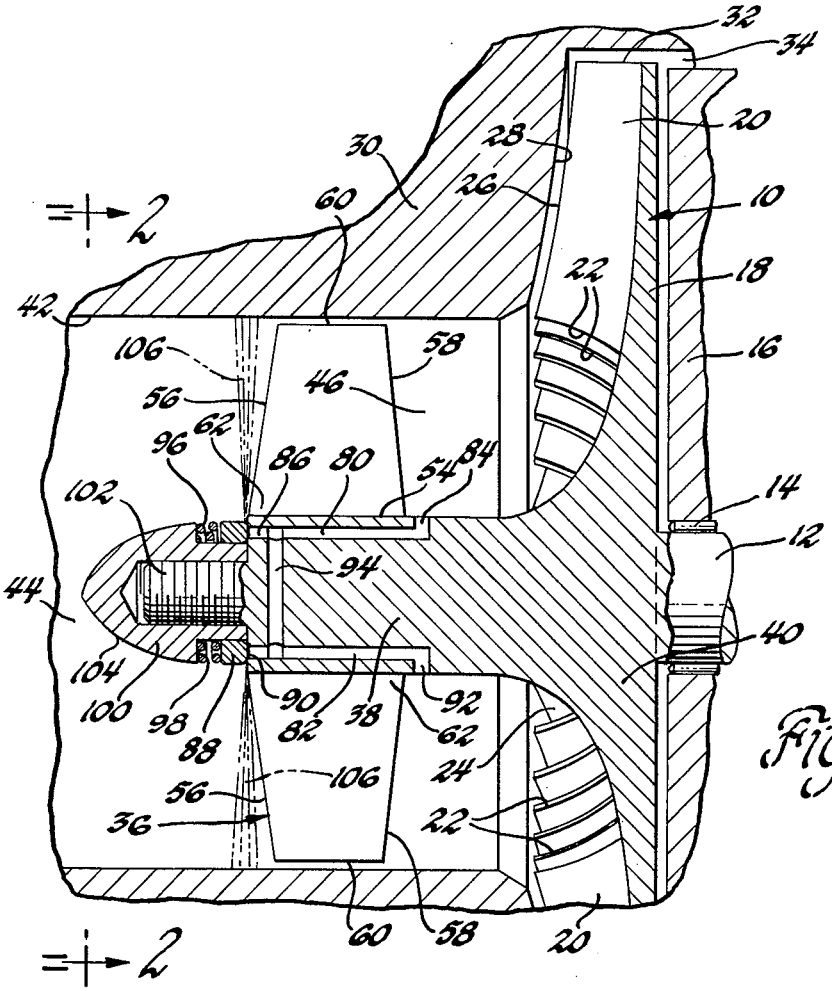
FIG. 1 is a longitudinal cross-sectional view of a high speed centrifugal pump including the inducer of the present invention.

Referring now to the drawing in FIG. 1, a high speed centrifugal pump impeller 10 is illustrated including a driven shaft 12 rotatably supported by means of a bearing 14 within a rear casing 16. The shaft 12 is connected to the rear wall 18 of the impeller 10 which is axially spaced with respect to the casing 16. The rear wall 18 has a plurality of centrifugal blades 20 thereon each including an inlet edge 22 located at circumferentially spaced points around an axial inlet eye 24 to the impeller 10. Each of the blades 20 further includes a radially outer edge 26 thereon located in close spaced relationship to the wall 28 of an annular shroud 30. The blades further include an outlet tip 32 for discharging liquid fuel into a supply passage 34 leading to a fuel supply system, for example, the fuel supply to an aircraft gas turbine engine of the type including an afterburner section therein.

In the illustrated arrangement the rotating shaft is driven in the range of 25,000 to 30,000 rpm, which is typical of high speed centrifugal pump operation for supplying fuel systems in an aircraft gas turbine engine application.

In such arrangements, it is observed that the vapor pressures of many fuels supplied to the engine is such that at such speeds of operation a vapor core may occur in the eye 24 of the high speed centrifugal impeller 10.

To counteract this affect and to assure a solid liquid core at the eye 24, in accordance with the present invention, the high speed centrifugal pump assembly 10 is associated with an improved upstream flow inducer assembly 36. Inducer assembly 36 includes an axial extension 38 from the hub 40 of the impeller 10 directed coaxially of an inlet bore 42. Bore 42 has a low pressure end 44 in communication with the fuel supply and a high pressure region 46 leading to the inlet eye 24 of the centrifugal impeller 10.

Figure 4:
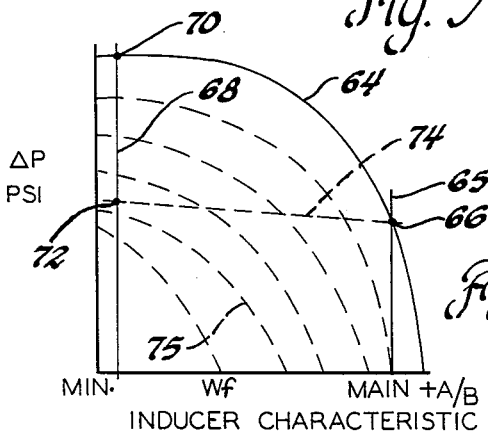
FIG. 4 is a graph showing the pressure differential and fuel flow characteristics of the inducer with and without the jet flap control of the present invention.
Figure 2:
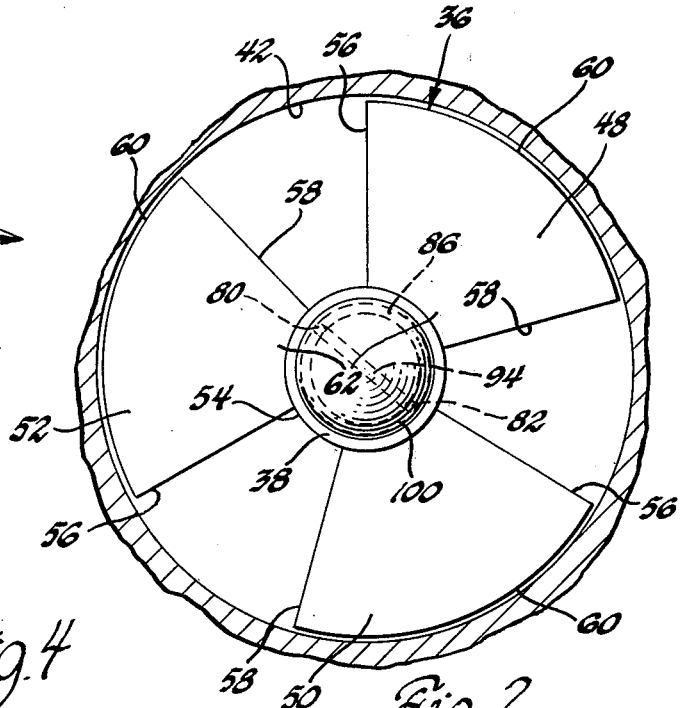
FIG. 2 is a vertical cross-sectional view taken along the line 2—2 of FIG. 1 looking in the direction of the arrows.

The inducer assembly 36 further includes a plurality of axial flow blades 48, 50 and 52 formed along the outer circumferential surface 54 of the extension 38. Each of the blades 48–52 includes a leading edge 56 and a trailing edge 58. A tip 60 on each of the blades 48–52 joins the leading edge 56 and the trailing edge 58. The tip 60 is located in close spaced relationship to the inner wall of the bore 42. Each of the blades 48–52 further includes a root segment 62 thereon for securing the blade to the outer circumferential surface 54. The blades 48, 50 and 52 thereby define an axial pump configuration for directing fuel from the low pressure inlet 44 and raising the energy level thereof to a high pressure in the region 46 prior to passage of the inlet fuel into the inlet eye 24 of the centrifugal pump impeller 10. Such an inducer configuration is characterized as having a pressure differential across the inducer assembly 36 which increases at lower fuel flow rates as shown in the graph of FIG. 4. Thus, at extremely low fuel flow rates represented by minimum Wf as shown in FIG. 4 at a maximum constant speed curve 64 the inducer assembly 36 will only have an optimized pressure differential at large fuel flow represented by MAIN + A/B where the vertical line 65 as shown in FIG. 4 intersects the curve 64 at point 66. For lower fuel flow rates there will be an excessive pressure drop up to a maximum pressure differential which occurs when the vertical line 68 in FIG. 4 intersects the speed curve 64 at point 70.

In accordance with the present invention the pressure drop characteristics found in a typical prior art axial flow type inducer is represented by the speed curve 64 in FIG. 4. It is modified in accordance with the present invention to have a modified characteristic at flow rate as represented by point 72 where the dotted line 74 (jet flap action) intersects line 68 in FIG. 4. This represents a resultant reduction of fuel flow being pumped by the high speed centrifugal pump impeller 10 along with a lower pressure rise across the inducer than would otherwise occur. In effect, it makes a high speed inducer act like an inducer having a lower constant speed characteristic line as shown at 75 in FIG. 4, even though it is driven at an elevated speed range of 25,000–30,000 rpm.

Figure 3:
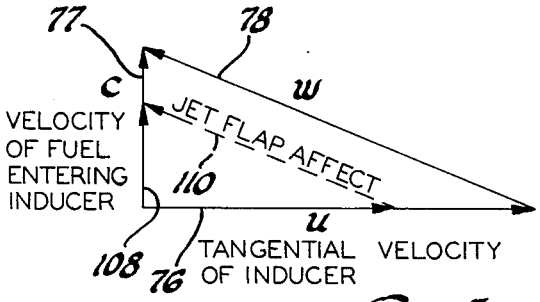
FIG. 3 is a vector diagram of velocity of fuel entering the inducer and the tangential velocity of the inducer.

More particularly, in the illustrated arrangement the tangential velocity of the inducer is designated U and is represented by the vector 76 in FIG. 3. At normal high speed low flow conditions the axial velocity component of fuel flow from the low pressure inlet 44 to the high pressure region 46 is represented by vector 77 in FIG. 3. A resultant velocity of the fuel entering the inducer relative to the blades is represented by the vector 78 in FIG. 3.

The present invention includes a plurality of axial passages 80, 82 in the shaft 38. The passage 80 includes an inlet 84 opening to the high pressure region 46 and an annular outlet 86 which is normally closed by a ring valve 88 including an annular tipped segment 90 thereon that blocks the outlet 86. Likewise, the passage 82 includes an inlet 92 in communication with the high pressure region 46 and outlet 86. A crossover passage 94 communicates with passages 80, 82.

In the illustrated arrangement, the ring valve 88 is biased into a closed position with respect to the outlet 86 by a compression spring 96 seated in an undercut groove 98 in the outer circumference of a conoidal retainer 100 that is threadably received on a threaded extension 102 of the shaft 38. The retainer 100 serves to locate the ring valve 88 in place with respect to the outlet 86 from bypass passages 80, 82 and further defines an outer surface of revolution 104 to define a smooth transition from the low pressure inlet 44 to the leading edges 56 of each of the blades 48, 50, 52.

Under high fuel flow operating conditions, the valve 88 is maintained closed so as to allow a smooth transition of inlet flow from the inlet 44 to the blades 48, 50, 52 which act on the fuel flow to increase fuel pressure to a point above the vapor pressure of the fuel thereby to assure a solid column of liquid flow into the high speed centrifugal impeller 10.

However, as shown in FIG. 4, at low engine fuel rates and high speeds of operation, which is typically the case where a fuel pump is rotated at a constant high speed in the range of 25,000 to 30,000 rpm, the pressure differential from the inlet 44 to the region 46 increases to a point which can affect the stability of flow of the fuel supply system. Accordingly, as the pressure in the region 46 increases above a predetermined desired level it will act through the passages 80, 82 against the ring valve 88 to cause the spring 96 to compress and produce a flap or curtain of fuel 106 in a plane perpendicular to the axis of extension 38. The curtain or flap action of the fuel flow from the outlet 86 reduces axial vector 108 for fuel flow from the high pressure to the low pressure side of each of the blades 48, 50, 52. This results in a lower effective resultant velocity 110 relative to the inducer. As a consequence, lesser quantities of fuel are pumped from the inducer 36 to the inlet eye 24 to thereby produce a lower pressure rise across the inducer than would otherwise occur when the shaft 38 extension is rotated in the range of 25,000 to 30,000 rpm.

While the embodiments of the present invention, as herein disclosed, constitute a preferred form, it is to be understood that other forms might be adopted.

The embodiments of the invention in which an exclusive property or privilege is claimed are defined as follows:

1. A fluid flow inducer for supplying inlet fuel flow to a high speed centrifugal pump comprising a housing with a bore therein, a rotating shaft driven by the centrifugal pump located concentrically within said bore, a conoidally configured inlet nose on said shaft, a plurality of circumferentially spaced inducer blades each having a leading edge, a base connected to said shaft and a tip located in close proximity to the wall of said bore and operative upon rotation of said shaft to produce a higher pressure in said bore downstream of said blades which increases as fuel flow rate is reduced through said bore, and means on said shaft including a valve responsive to pressure in said bore downstream of said blades and an outlet from said shaft closely adjacent said leading edge to produce a radially outwardly directed curtain of fuel slung from said rotating shaft immediately upstream of said blades when a predetermined downstream pressure occurs, said curtain reducing the axial inlet velocity component of fuel flow at the leading edge of each of said blades to stabilize fuel flow across the inducer during low flow, high speed operating conditions.

2. A fluid flow inducer for supplying inlet fuel flow to a high speed centrifugal pump comprising a housing with a bore therein, a rotating shaft driven by the centrifugal pump located concentrically within said bore, a conoidally configured inlet nose on said shaft, a plurality of circumferentially spaced inducer blades each having a leading edge, a base connected to said shaft and a tip located in close proximity to the wall of said bore and operative upon rotation of said shaft to produce a higher pressure in said bore downstream of said blades which increases as fuel flow rate is reduced through said bore, and means including a valve carried by said shaft and an outlet from said shaft closely adjacent said leading edge at a point upstream of said blades and responsive to pressure in said bore downstream of said blades to produce a radially outwardly directed curtain of fuel slung from said rotating shaft immediately upstream of said blades when a predetermined downstream pressure occurs, said curtain reducing the axial velocity component of fuel flow at the leading edge of each of said blades to stabilize fuel flow across the inducer during low flow, high speed operating conditions.

3. A fluid flow inducer for supplying inlet fuel flow to a high speed centrifugal pump comprising a housing with a bore therein, a rotating shaft driven by the centrifugal pump located concentrically within said bore, a conoidally configured inlet nose on said shaft, a plurality of circumferentially spaced inducer blades each having a leading edge, a base connected to said shaft and a tip located in close proximity to the wall of said bore and operative upon rotation of said shaft to produce a higher pressure in said bore downstream of said blades which increases as fuel flow rate is reduced through said bore, a passage in said shaft bypassing said blades and having an outlet closely adjacent said leading edge, a valve carried by said shaft controlling flow through said passage outlet, means for spring biasing said valve to close said outlet and responsive to pressure in said bore downstream of said blades to open said outlet to produce a radially outwardly directed curtain of fuel slung from said rotating shaft immediately upstream of said blades when a predetermined downstream pressure occurs, said curtain reducing the axial inlet velocity component of fuel flow at the leading edge of each of said blades to stabilize fuel flow across the inducer during low flow, high speed operating conditions.

* * * * *